US010976066B2

(12) United States Patent
Dorsch

(10) Patent No.: US 10,976,066 B2
(45) Date of Patent: Apr. 13, 2021

(54) SYSTEMS AND METHODS FOR MITIGATING ICE FORMATION CONDITIONS IN AIR CONDITIONING SYSTEMS

(71) Applicant: KBE, Inc., Orange, CA (US)

(72) Inventor: Kirk Allen Dorsch, Huntington Beach, CA (US)

(73) Assignee: KBE, Inc., Orange, CA (US)

( * ) Notice: Subject to any disclaimer, the term of this patent is extended or adjusted under 35 U.S.C. 154(b) by 0 days.

(21) Appl. No.: 16/140,426

(22) Filed: Sep. 24, 2018

(65) Prior Publication Data

US 2019/0120516 A1 Apr. 25, 2019

Related U.S. Application Data

(60) Provisional application No. 62/574,476, filed on Oct. 19, 2017.

(51) Int. Cl.
*F24F 11/43* (2018.01)
*F24F 11/70* (2018.01)
(Continued)

(52) U.S. Cl.
CPC ..... *F24F 11/43* (2018.01); *F24F 11/70* (2018.01); *F24F 11/88* (2018.01); *F24F 11/89* (2018.01); *F24F 2140/20* (2018.01)

(58) Field of Classification Search
CPC .. F24F 11/41; F24F 11/43; F24F 11/88; F24F 11/30; F24F 11/89; F24F 11/70–875;
(Continued)

(56) References Cited

U.S. PATENT DOCUMENTS 4,315,413 A * 2/1982 Baker ..... F25B 49/02 62/180
4,433,555 A * 2/1984 Thorsen ..... F25D 21/002 62/154

(Continued)

FOREIGN PATENT DOCUMENTS

EP 1306244 B1 5/2003
EP 2880375 A2 6/2015

OTHER PUBLICATIONS

Butterfield, A., & Szymanski, J. (2018). relay. In a Dictionary of Electronics and Electrical Engineering. : Oxford University Press. Retrieved Apr. 22, 2020, from https://www.oxfordreference.com/view/10.1093/acref/9780198725725.001.0001/acref-9780198725725-e-4013. (Year: 2018).*

(Continued)

*Primary Examiner* — Jianying C Atkisson
*Assistant Examiner* — Miguel A Diaz
(74) *Attorney, Agent, or Firm* — Knobbe, Martens, Olson & Bear, LLP

(57) ABSTRACT

Some embodiments provide a system or a method to switch off an air conditioning system when an ice formation condition is present. The ice formation condition is present when the temperature, in either degrees Celsius or Fahrenheit, at an indoor evaporator unit or an indoor evaporator coil is below a threshold temperature. Some embodiments allow a user to change the threshold temperature. The system can include a user interface to provide notifications when an ice formation condition is present.

22 Claims, 5 Drawing Sheets

(51) Int. Cl.
*F24F 11/89* (2018.01)
*F24F 11/88* (2018.01)
*F24F 140/20* (2018.01)

(58) Field of Classification Search
CPC .. F24F 11/32; F24F 11/38; F24F 11/50; F24F 11/52; F24F 11/523; F24F 11/526; F24F 11/56; F24F 11/57; F24F 11/58; F24F 2140/20; F25B 2700/11; F25B 2313/0314; F25B 47/006; F25D 21/00; F25D 21/002; F25D 21/004; F25D 21/006; F25D 21/02; F25D 21/04; F25D 21/06
See application file for complete search history.

(56) References Cited

U.S. PATENT DOCUMENTS 4,549,403 A * 10/1985 Lord ..... F25B 49/02 62/201
4,768,348 A * 9/1988 Noguchi ..... B60H 1/321 62/211
RE33,119 E * 11/1989 Baker ..... F25B 49/02 374/102
4,903,759 A * 2/1990 Lapeyrouse ..... G05D 23/1917 165/11.1
5,038,575 A * 8/1991 Yamada ..... F25D 21/008 62/234
5,065,593 A 11/1991 Dudley et al.
5,198,809 A * 3/1993 Day ..... G05B 19/08 340/2.1
5,216,897 A * 6/1993 Tsuchiyama ..... G05B 19/0428 62/158
5,965,814 A 10/1999 French et al.
6,205,800 B1 * 3/2001 Topper ..... A47F 3/0404 62/156
6,212,892 B1 * 4/2001 Rafalovich ..... F25B 5/04 62/90
6,438,973 B1 * 8/2002 Yoshida ..... F25B 49/005 361/33
6,625,997 B1 * 9/2003 Schultz ..... B60H 1/00792 374/147
7,131,281 B2 11/2006 Salim et al.
9,562,710 B2 2/2017 Pham et al.
9,593,861 B1 3/2017 Burnett
9,638,436 B2 5/2017 Arensmeier et al.
9,995,515 B2 * 6/2018 Liu ..... F25B 41/20
2003/0061822 A1 * 4/2003 Rafalovich ..... F24F 3/1405 62/92
2003/0163222 A1 * 8/2003 Choi ..... G05D 23/1902 700/277
2004/0168451 A1 9/2004 Bagley
2005/0046563 A1 * 3/2005 Whitney ..... F24F 11/70 340/506
2006/0230768 A1 * 10/2006 Huber ..... F25D 21/008 62/126
2009/0038325 A1 * 2/2009 Yagi ..... F24F 1/06 62/259.1
2009/0049849 A1 * 2/2009 Kim ..... F25B 49/022 62/156
2009/0133419 A1 * 5/2009 Matsuno ..... F25B 49/025 62/239
2010/0307174 A1 12/2010 Kernkamp
2011/0088416 A1 4/2011 Koethler
2011/0126560 A1 * 6/2011 Wightman ..... F25B 47/02 62/80
2013/0158723 A1 * 6/2013 Erickson ..... F24F 11/30 700/278
2014/0149270 A1 5/2014 Lombard et al.
2015/0053779 A1 * 2/2015 Adamek ..... F24F 11/30 236/1 C
2015/0156031 A1 * 6/2015 Fadell ..... H04L 12/2816 700/276
2015/0204578 A1 * 7/2015 Kaiser ..... F24H 3/065 237/55
2015/0204589 A1 * 7/2015 Liu ..... F25B 1/10 62/80
2015/0338116 A1 * 11/2015 Furuta ..... F24F 11/30 700/276
2016/0103457 A1 4/2016 Maughan et al.
2016/0258648 A1 * 9/2016 Liu ..... F24F 11/30
2016/0306538 A1 * 10/2016 Yamamoto ..... F24F 11/30
2016/0320110 A1 * 11/2016 Ishida ..... F24F 2110/00
2016/0370026 A1 12/2016 Denton et al.
2017/0059198 A1 * 3/2017 Roth ..... F24F 11/30
2017/0082308 A1 * 3/2017 Gokhale ..... F25B 47/006
2017/0130974 A1 5/2017 Mercer et al.
2017/0261251 A1 * 9/2017 Cho ..... F25D 17/062
2017/0292725 A1 * 10/2017 Conley ..... G05B 19/048
2018/0017300 A1 * 1/2018 Shockley ..... F25B 49/02
2018/0209703 A1 * 7/2018 Hern ..... F25B 49/02
2018/0283723 A1 * 10/2018 Ock ..... F24F 11/63
2018/0283724 A1 * 10/2018 Van Eldik ..... F24F 11/72
2018/0299150 A1 * 10/2018 Ajax ..... F24F 11/0001

OTHER PUBLICATIONS

Butterfield, A., & Szymanski, J. (2018). thyristor. In a Dictionary of Electronics and Electrical Engineering. : Oxford University Press. Retrieved Apr. 22, 2020, from https://www.oxfordreference.com/view/10.1093/acref/9780198725725.001.0001/acref-9780198725725-e-4740. (Year: 2018).*

* cited by examiner

SYSTEMS AND METHODS FOR MITIGATING ICE FORMATION CONDITIONS IN AIR CONDITIONING SYSTEMS

INCORPORATION BY REFERENCE

This application claims the benefit of U.S. Provisional Patent Application No. 62/574,476, filed Oct. 19, 2017, titled "Systems and Methods for Mitigating Ice formation Conditions in Air Conditioning Systems," the entire contents of which are incorporated by reference herein and made part of this specification.

BACKGROUND

Field

This disclosure is related generally to mitigating ice formation in an indoor evaporator unit of an air conditioning system.

Description of Related Art

Air conditioning systems can remove heat from the interior of an occupied space to improve the comfort of occupants. Air conditioning can be used in various environments. Air conditioners can be used to achieve a more comfortable interior environment, typically for humans or animals; however, air conditioning is also used to cool and/or dehumidify an interior space, including spaces containing items such as computer servers, power amplifiers, and artwork.

Air conditioners can use a blower to distribute conditioned air to an occupied space in a building to improve thermal comfort and indoor air quality. Electric refrigerant-based air conditioning units range from small units that can cool a small room to massive units installed on the roof of office towers that can cool a large building. The cooling can be achieved through a refrigeration cycle. An air conditioning system can include an outdoor condenser unit and an indoor evaporator unit connected to each other with a refrigerant circuit.

SUMMARY

Some disclosed embodiments provide a system or a method to switch off an air conditioning system when an ice formation condition is present. The ice formation condition is present when the temperature, in either degrees Celsius or Fahrenheit, at an indoor evaporator unit or an indoor evaporator coil is below a threshold temperature. Some embodiments allow a user to change the threshold temperature. The system can include a user interface to provide notifications when an ice formation condition is present.

This disclosure describes example systems and methods for mitigating ice formation in an indoor evaporator unit of an air conditioning system by monitoring for ice formation conditions in the indoor evaporator unit and terminating the air conditioning system when there is an ice formation condition present. Sensors are operatively connected to the indoor evaporator coil of the indoor evaporator unit. The sensors monitor temperature of the indoor evaporator coil and transmit a signal to a hardware processor. The hardware processor receives the signal from the sensors and compares the signal to a threshold value. When the hardware processor determines that the temperature of the indoor evaporator coil is less than the threshold value, it generates a notification and switches off the air conditioning system. The system may be provided to existing air conditioning systems with a wide variety of air conditioning unit configurations.

Thus, in accordance with some embodiments, a system for mitigating ice formation in an indoor evaporator unit of an air conditioning system comprises a temperature sensor responsive to thermal energy of the indoor evaporator coil, the temperature sensor attached to the indoor evaporator coil of the indoor evaporator unit, the temperature sensor comprising a thermal contact in thermal communication with the indoor evaporator unit, the sensor configured to generate a thermal data associated with the temperature of the indoor evaporator coil. The system can also comprise a hardware processor in electronic communication with the temperature sensor. The system can also comprise a memory device in electronic communication with the hardware processor, wherein the memory device can store information comprising a threshold temperature value and machine readable instructions. The system for mitigating ice formation can further comprise a user interface device comprising a display configured to display a maintenance indicator in response to the hardware processor generating the notification signal.

In some embodiments, the sensor can be coupled to an inlet of the indoor evaporator coil. The sensor can also be coupled to an outlet of the indoor evaporator coil. In the alternative, the sensor can also be coupled to any location between the inlet and the outlet of the indoor evaporator coil.

In some embodiments, the machine readable instructions stored in the memory device, when executed, cause the hardware processor to receive the thermal data from the sensor. The machine readable instruction can also determine a temperature parameter of the indoor evaporator coil using the thermal data received from the sensor. For example, the thermal data from the sensor can be in resistance, current, and/or voltage. The hardware can determine the temperature parameter of the indoor evaporator coil from the thermal data using either a look-up table or an algorithm. The machine readable instructions can also cause the hardware processor to compare the temperature parameter of the indoor evaporator coil to the threshold temperature value and determine that ice formation conditions are present when the temperature parameter of the indoor evaporator coil is less than or equal to the threshold temperature value. In response to determining that ice formation conditions are present, the hardware processor can shut off the air conditioning system and generate a notification signal. In some embodiments, the notification is displayed on the user interface device until additional input is provided.

In some embodiments, the user device is a mobile device. The user interface device can be an electronic device located inside the system or a building. In other embodiments, the user interface device is a thermostat in a building or a house.

In certain variants, the thermal data received from the temperature sensor comprises at least one of voltage, current, or resistance associated with the temperature of the indoor evaporator coil. The thermal data can be collected, by the sensor continuously or intermittently.

Further, in some embodiments, the threshold temperature value is between 25 and 32 degrees Fahrenheit. In other embodiments, the threshold value can be that of voltage (in volts), current (in ampere), or resistance (in ohms). For example, the temperature sensor can generate a voltage reading and transmits that voltage reading to the hardware processor. The hardware processor, in turn, compares the voltage reading to the threshold value in volts. The temperature data generated and transmitted to the hardware processor can be in amperes or ohms. Likewise, the threshold value can be in amperes or ohms.

In certain variant, the system for mitigating ice formation in an indoor evaporator unit of an air conditioning system comprises a relay comprising a first position and a second position. The relay in the first position can allow the air conditioning system to receive power from a power supply, and preventing the air conditioning system from receiving power from the power supply while the relay is in the second position. In some embodiments, the relay can be biased to stay in the first position and be moved from the first position to the second position when the ice formation condition is present.

In some aspects, a method of mitigating ice formation in an indoor evaporator unit of an air conditioning system can comprise receiving thermal data from a sensor in thermal communication with the indoor evaporator unit of the air conditioning system, the sensor responsive to thermal energy of the indoor evaporator unit. The method can further comprise comparing the thermal data of the indoor evaporator coil to a threshold value. The method can further comprise determining that an ice formation condition is present based on the comparison between the thermal data of the indoor evaporator coil to a threshold value. The method can also comprise shutting off the air conditioning system in response to determining that an ice formation condition is present.

In accordance to some variants, a method for installing a system to mitigate ice formation in an indoor evaporator unit of an air conditioning system can comprise installing a sensor to a first location of an indoor evaporator coil of the indoor evaporator unit. The sensor can comprise a thermal contact in thermal communication with the indoor evaporator unit, and configured to generate a thermal data associated with a temperature of the indoor evaporator coil. The method for installing the system to mitigate ice formation can also comprise establishing a connection between a hardware processor and the sensor. The method for installing the system to mitigate ice formation can further comprise installing a relay coupled to the hardware processor and a power supply for the air conditioning system. The relay can comprise a first position and a second position, the relay configured to prevent the air conditioning system from receiving power from the power supply when in the second position. In some embodiments, the hardware processor, in response to determining that an ice formation condition is present, can move the relay from the first position to the second position to shut off the air conditioning system.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

DETAILED DESCRIPTION OF EMBODIMENTS

Example embodiments described herein have several features, no single one of which is indispensable or solely responsible for their desirable attributes. Without limiting the scope of the claims, some of the advantageous features of some embodiments will be described.

Some embodiments provide a system comprising a hardware processor with a memory device and at least one sensor. The system can include a mode of operation configured to determine that ice formation conditions are present in the indoor evaporator unit of an air conditioning system. The mode of operation can be configured to switch off the air conditioning system when ice formation conditions are present in the indoor evaporator unit of the air conditioning system. The system can include various types of sensors configured to detect voltage, current, resistance, or temperature. The system can be modular and be installed to an existing air conditioning system.

Figure 1:
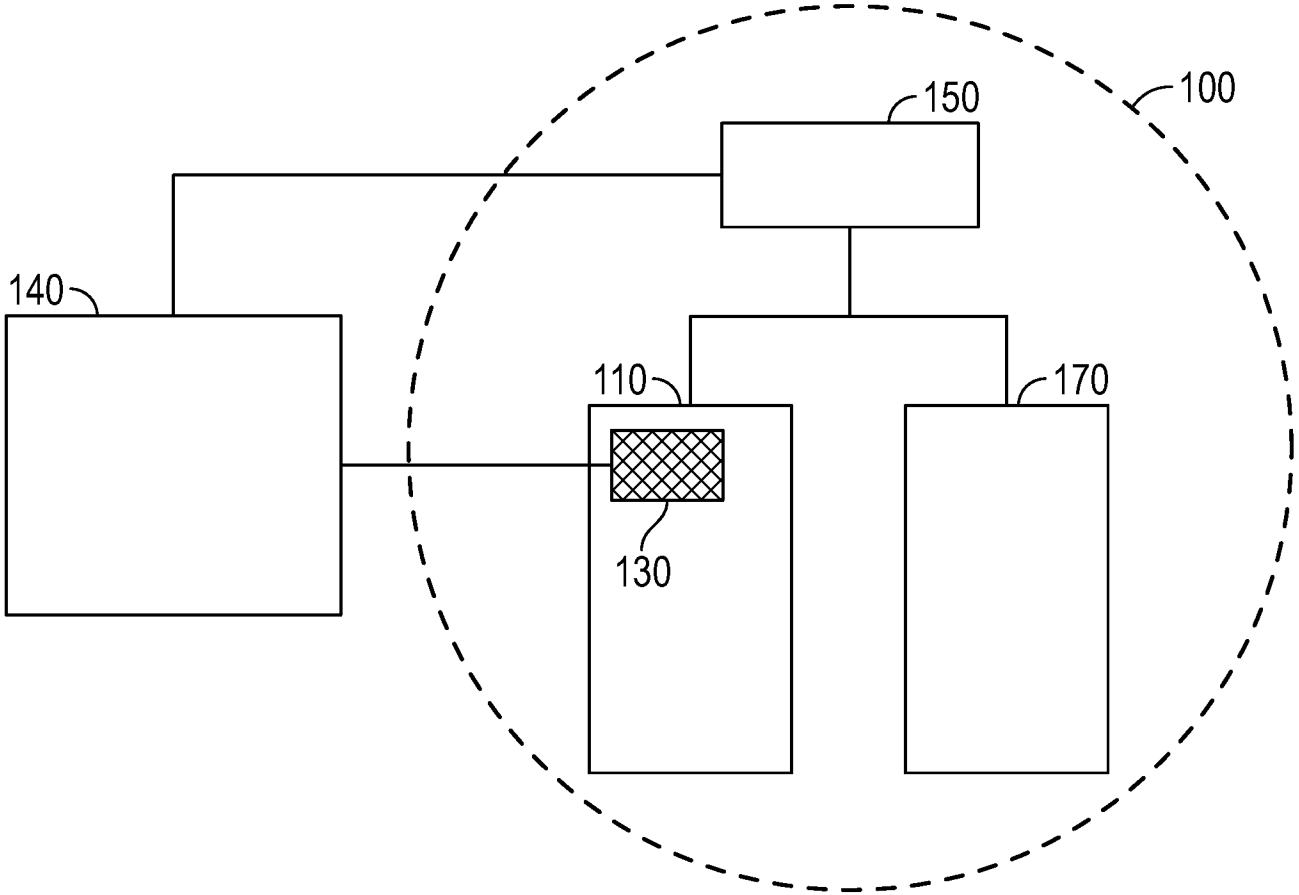
FIG. 1 is a schematic diagram of an embodiment of an icing mitigation system for an air conditioner.

FIG. 1 is a schematic of an embodiment depicting a hardware processor 140 and an air conditioning system 100 comprising an indoor evaporator unit 110, a sensor 130, an outdoor condenser unit 170, and an air conditioning system control board 150. The hardware processor 140 is operatively connected to the sensor 130 and the air conditioning system control board 150, and the sensor 130 is operatively connected to the indoor evaporator unit 110. The air conditioning system control board 150 is operatively connected to indoor evaporator unit 110 and the outdoor condenser unit 170.

In one embodiment, physical wires are used to establish connection between the hardware processor 140, the sensor 130, and the air conditioning system control board 150. The wires are also used to establish connection between the air conditioning system control board 150, the indoor evaporator unit 110, and the outdoor condenser unit 170. In another embodiment, wireless communication establishes connection between the hardware processor 140, the sensor 130, and the air conditioning system control board 150. Wireless communication is also used to establish connection between the air conditioning system control board 150, the indoor evaporator unit 110, and the outdoor condenser unit 170.

In some embodiments, the sensor 130 measures temperature of the indoor evaporator unit 110. The sensor 130 then transmits the temperature measurement in a form of a signal to the hardware processor 140. The signal transmitted by the sensor 130 comprises at least one of voltage, current, resistance, or temperature. Once the hardware processor 140 receives the signal from the sensor 130, it determines the temperature of the indoor evaporator unit 110, and compares the temperature with a threshold value. If the temperature is greater or equal to the threshold value, then the hardware processor 140 waits for next signal from the sensor 130. If the temperature is less than the threshold temperature value, then the hardware processor 140 switches off the air conditioning system 100. In one embodiment, the threshold value is a value between 25 and 32 degrees Fahrenheit. In other embodiments, the threshold value comprises at least one of voltage, current, resistance, or temperature.

In one embodiment, the sensor 130 is a thermocouple. In other embodiments, the sensor 130 is either a resistor temperature detector (RTD) or a thermistor. In some embodiments, the sensor 130 is either a semiconductor or infrared (IR) sensor. The sensor 130 is a digital output temperature sensor in other embodiments. The sensor 130 will transmit different types of signals to the hardware processor 140 depending on what type of sensor the sensor 130 is. For example, RTD is a temperature sensor that measures changes in resistance as temperature changes. Therefore RTD sensor outputs resistance value that can be translated to a temperature value.

Figure 2:
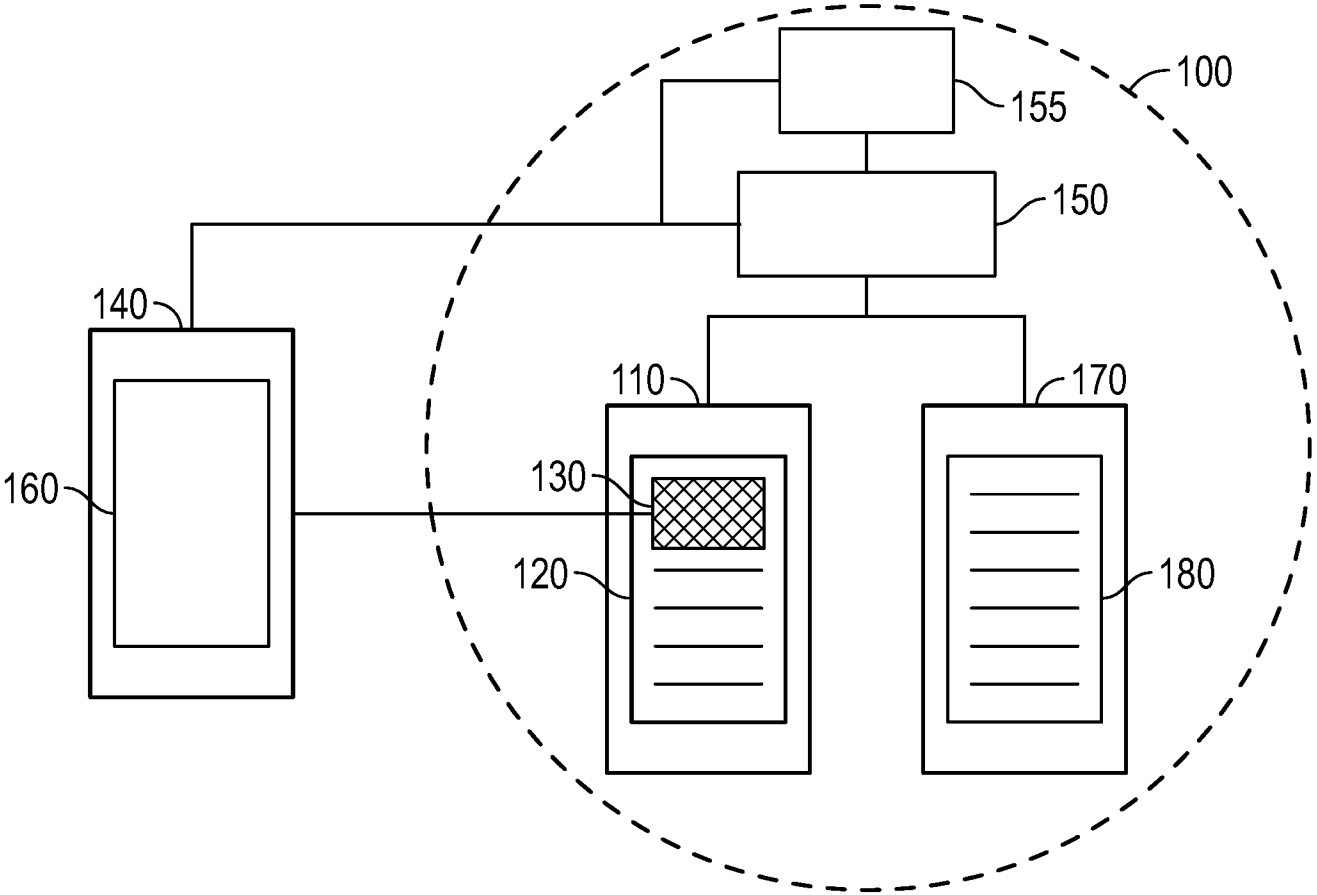
FIG. 2 is a schematic diagram of another embodiment of an icing mitigation system for an air conditioner.

FIG. 2 is a schematic diagram of another embodiment of an icing mitigation system for an air conditioner that can be similar in many respects to the embodiment illustrated in FIG. 1 and include additional features as described hereinafter. FIG. 2 illustrates an embodiment in which a hardware processor 140 is operatively connected to a memory 160. The air conditioning system 100 can comprise an indoor evaporator unit 110, an indoor evaporator coil 120, an air conditioning system control board 150, a thermostat 155, an outdoor condenser unit 170, and an outdoor condenser coil 180. A sensor 130 can be installed on the indoor evaporator coil 120.

In some embodiments, the sensor 130 is coupled to an inlet of the indoor evaporator coil 120. In other embodiments, the sensor 130 is coupled to an outlet of the indoor evaporator coil 120. The sensor 130 can also be coupled to any location on the indoor evaporator coil 120 that is between the inlet and the outlet of the indoor evaporator coil 120.

The hardware processor 140 is operatively connected to the memory 160, the sensor 130, the air conditioning system control board 150, and the thermostat 155. The sensor 130 is operatively connected to the indoor evaporator coil 120, which is operatively connected to the indoor evaporator unit 110. The indoor evaporator unit 110 is operatively connected to the outdoor condenser unit 170, which is operatively connected to the outdoor condenser coil 180. Both the indoor evaporator unit 110 and the outdoor condenser unit 170 are operatively connected to the air conditioning system control board 150 so that they are able to communicate with the hardware processor 140.

In some embodiments, the sensor 130 is installed at a point proximate to the indoor evaporator coil 120. In other embodiments, the sensor 130 is installed inside the evaporator to measure the temperature of the refrigerant flowing inside the indoor evaporator coil 120. In some embodiments, the sensor 130 is detachably installed on the indoor evaporator coil 120, whereas in other embodiments, the sensor 130 is permanently fixed on the indoor evaporator coil 120.

In some embodiments, the memory 160 of the hardware processor 140 is installed in a remote location. For example, the memory 160 may be installed in a separate compartment as the hardware processor 140. In other embodiments, the memory 160 may comprise of a network of computing devices located in remote locations. The memory 160 can store information comprising predetermined threshold data and machine readable instructions that, when executed, cause the hardware processor 140 to collect temperature data from the sensor 130, determine temperature of the indoor evaporator coil 120 from the temperature data, compare the temperature of the indoor evaporator coil 120 to the predetermined threshold data, determine that ice formation conditions are present when the temperature parameter of the indoor evaporator coil 120 is less than or equal to the threshold temperature value, and in response to determining that ice formation conditions are present, shut off the air conditioning system 100. The method of operation of the ice mitigation system will be further described below.

Figure 3:
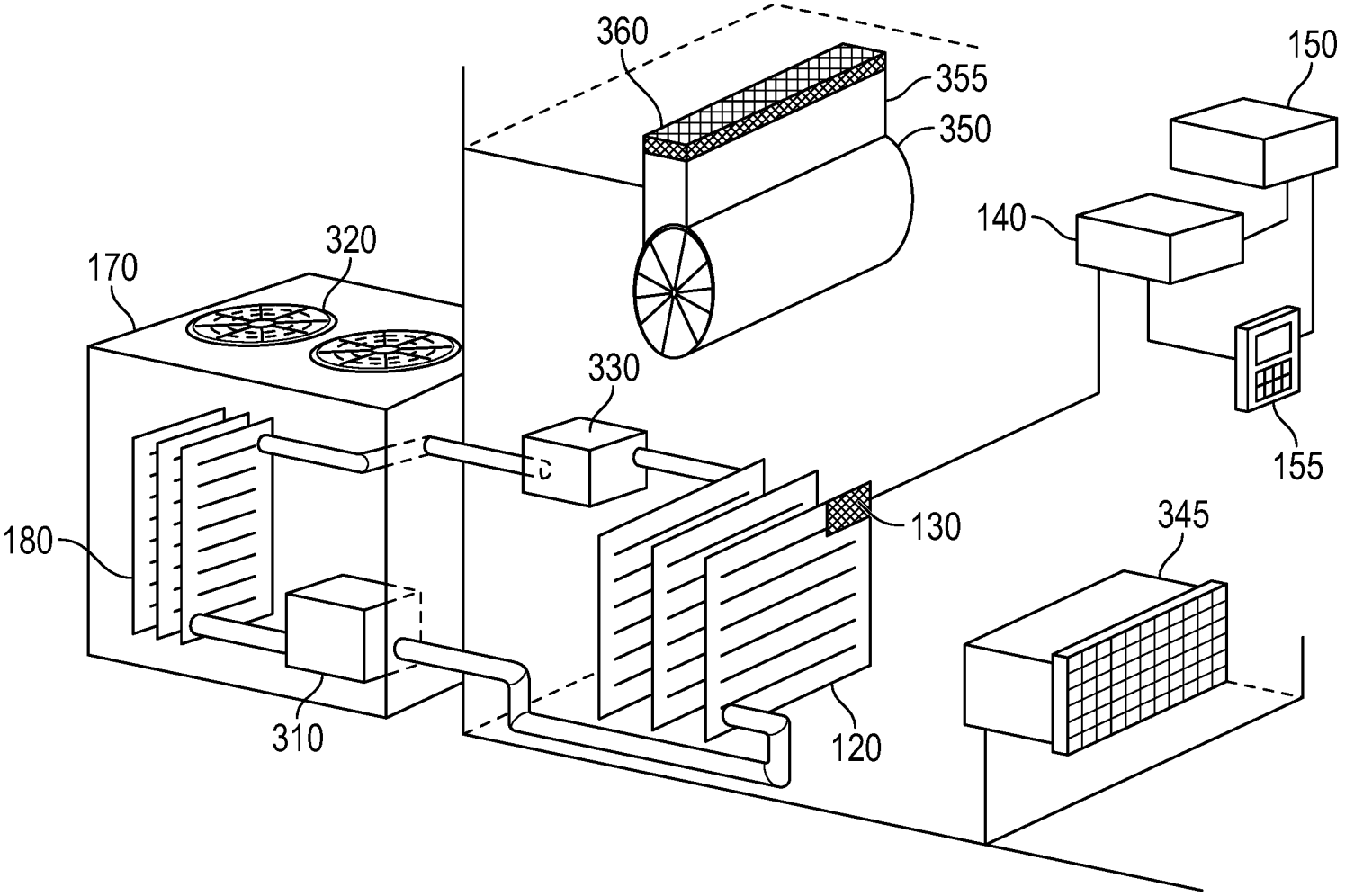
FIG. 3 is an isometric view of another embodiment of an air conditioner with an icing mitigation system.

FIG. 3 illustrates another embodiment of an air conditioner with an icing mitigation system that can be similar in many aspects to the embodiments shown in FIGS. 1 and 2, and it can include additional features as described hereinafter. FIG. 3 is an isometric view of internal components of another embodiment comprising the outdoor condenser unit 170, the indoor evaporator unit 110, the hardware processor 140, air conditioning system control board 150, and the thermostat 155. The outdoor condenser unit 170 comprises a compressor 310, the outdoor condenser coil 180, and an outdoor condense fan 320. The indoor evaporator unit 110 comprises an expansion valve 330, the indoor evaporator coil 120, an air intake duct 345, a blower 350, an air outtake duct 355, and an air filter 360.

In some embodiments, refrigerant flows from the indoor evaporator coil 130 to the compressor 310. The compressor 310 then pressurizes the refrigerant and pushes it towards the outdoor condenser coil 180. The outdoor condenser coil 180 transfers heat from the refrigerant to outside air. The outdoor condenser fan 320 creates airflow for the heat transfer. The outdoor condenser coil 180 is operatively connected to the expansion valve 330 to allow refrigerant to flow from the outdoor condenser valve 180 to the expansion valve 330. The expansion valve depressurizes the refrigerant, which then flows towards the indoor evaporator coil 120. The indoor evaporator coil 120 transfers heat from the refrigerant to inside air. The blower 350 generates airflow within the indoor condenser unit 170. The air intake duct 345 allows inside air to enter the indoor condenser unit 170, while the air outtake duct 355 allows inside air to exit the indoor condenser unit 170. The hardware processor 140 is operatively connected to the air conditioning system control board 150, the thermostat 155, and the sensor 130, which is operatively connected to the indoor evaporator coil 120.

The sensor 130 can be installed at more than one locations. In some embodiments, the sensor 130 is installed at a point at which refrigerant enters the indoor evaporator coil 120 and another point at which refrigerant exits the indoor evaporator coil 120. In other embodiments, the sensor 130 is installed at various locations between the points at which refrigerant enters and exits the indoor evaporator coil 120.

The thermostat 155 can be a user interface device that comprises a display. The display of the user interface device can show temperature of a house or a building, along with a predetermined, configurable target temperature. The display can also display notifications generated by the hardware processor 140. For example, when the temperature of the indoor evaporator coil 120 dips below a predetermined temperature, the hardware processor 140 can generate a notification signal, which prompts the display of the user interface device to display a notification. The notification can be in a form of a light. In some embodiments, the notification can be in a form of text or sound.

In some embodiments, the notification on the user interface device is temporary. The user interface can show a text-based notification for a predetermined duration. For example, the user interface device can display the notification for at least an hour. In another example, the user interface device can display the notification for duration of time between 10 minutes and 6 hours. In other embodiments, the notification can be displayed until additional input is provided. For example, the notification can be shown on the user interface device, prompting an input from a user. The notification can be displayed on the user interface device until an input from a user is received.

The user interface device can be located at various different locations. The user interface device can be located inside the air conditioning system. In some embodiments, the user interface can be located inside of a building in which the air conditioning system is installed. However, the user interface can also be located remotely. It is contemplated that the user interface device can also be a mobile device. For example, a mobile device can receive a notification signal from the hardware processor 140 of the air conditioning system wirelessly. The mobile device can be a mobile phone or a mobile computing device such as a tablet with wireless communication capabilities.

In some embodiments, a fan, instead of the blower 350, generates airflow through the indoor evaporator unit 110.

Figure 4:
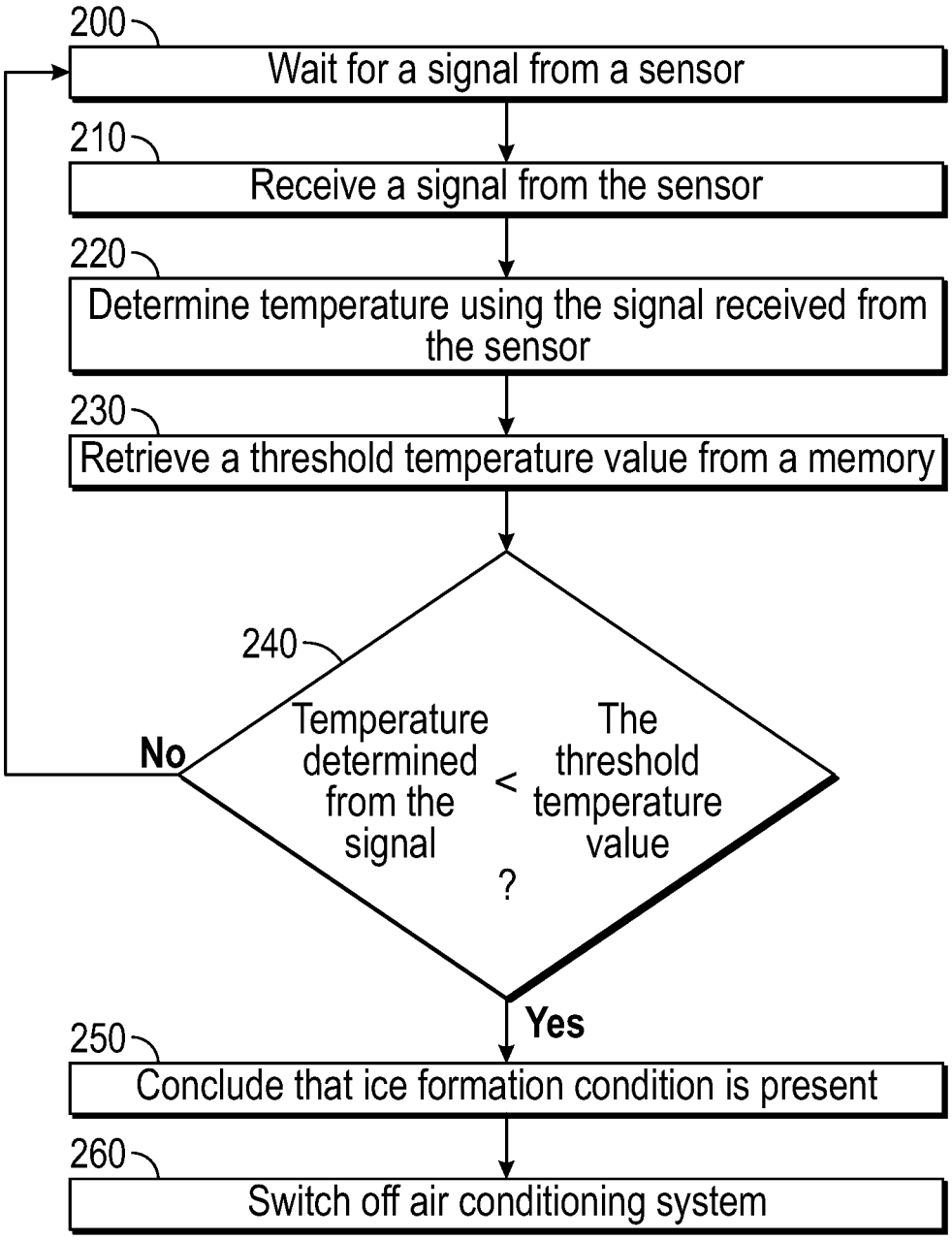
FIG. 4 is a flow chart showing an example process for mitigating icing conditions in an air conditioner.

FIG. 4 is a flow chart showing an example process for mitigating icing conditions in an air conditioner, such as, for example the air conditioner shown in FIG. 1, 2, or 3. While a particular order of steps is disclosed, the steps can be arranged in other orders unless otherwise indicated. Steps can be removed or added at any point in the process without deviating from the scope of this disclosure. The process can begin at step 200, at which the hardware processor 140 waits for a signal from the sensor 130 operatively connected to the indoor evaporator coil 120. At step 210, the hardware processor 140 receives a signal from the sensor 130. At step 220, the hardware processor 140 determines the temperature at the indoor evaporator coil 120 using the signal received from the sensor 130. At step 230, the hardware processor retrieves a temperature threshold value from the memory 160. At step 240, the hardware processor determines whether the temperature at the point on the indoor evaporator coil 120 is less than or equal to the temperature threshold value retrieved from the memory 160. If the temperature at the point on the indoor evaporator coil 120 is greater than the threshold temperature value, the method goes back to the step 200. If the temperature at the point on the indoor evaporator coil 120 is less than or equal to the threshold temperature value, the process then proceeds to step 250, at which the hardware processor 140 determines that ice formation conditions are present. At step 260, the hardware processor switches off the air conditioning system 100.

In some embodiments, the sensor 130 collects temperature measurements continuously. In other embodiments, the sensor 130 collects temperature measurements intermittently. As known to those having ordinary skill in the art, the sensor 130 may collect temperature measurements at a regular interval. The temperature measurements can comprise at least one of voltage, current, resistance, or temperature.

In some embodiments, the hardware processor 140 determines the temperature at the indoor evaporator coil 120 by using a method comprising at least one of voltage-to-temperature conversion, current-to-temperature conversion, and resistance-to-temperature conversion. In other embodiments, the hardware processor 140 determines the temperature at the indoor evaporator coil 120 by using digital signal received from the sensor 130. In some embodiments, the sensor 130, instead of the hardware processor 140, determines the temperature at the indoor evaporator coil 120.

In other embodiments, the hardware processor 140, instead of determining the temperature of the indoor evaporator coil 120 using the signal received from the sensor 130, will instead directly compare the signal to the threshold value comprising at least one of voltage value, current value, or resistance value. For example, the hardware processor 140 receives a signal from the sensor 130 comprising a resistance value. Then the hardware processor 140 compares the resistance value from the signal to a threshold resistance value retrieved from the memory 160 to determine whether an ice formation condition is present. In some embodiments, ice formation condition is present when the resistance value from the signal is less than the threshold resistance value. In some embodiments, ice formation condition is present when the resistance value from the signal is greater than the threshold resistance value.

In some embodiments, the hardware processor 140 receives a signal from the sensor 130 comprising a voltage value. Then the hardware processor 140 compares the voltage value from the signal to a threshold voltage value retrieved from the memory 160 and determines whether an ice formation condition is present. In some embodiments, ice formation condition is present when the voltage value from the signal is less than the threshold voltage value. In some embodiments, ice formation condition is present when the voltage value from the signal is greater than the threshold voltage value.

In another embodiment, the hardware processor 140 receives a signal from the sensor 130 comprising a current value. Then the hardware processor 140 compares the current value from the signal to a threshold current value retrieved from the memory 160 and determines whether an ice formation condition is present. In some embodiments, ice formation condition is present when the current value from the signal is less than the threshold current value. In some embodiments, ice formation condition is present when the current value from the signal is greater than the threshold current value.

Other embodiments involve the hardware processor 140 generating a notification for a user interface when an ice formation condition is present. In other embodiments, there is a delay, with a configurable length, before the hardware processor generates the notification. Once the hardware processor 140 determines that an ice formation condition is present, it will generate the notification after a configured length of time has passed.

Other embodiments involve the hardware processor 140 terminating the air conditioning system 100 when an ice formation condition is present. In some embodiments, there is a delay, with a configurable length, before the hardware processor switches off the air conditioning system 100. Once the hardware processor 140 determines that an ice formation condition is present, it will switch off the air conditioning system 100 after a configured length of time has passed.

In some embodiments, the hardware processor 140 terminates the air conditioning system 100 using a relay connected to a power source for the air conditioning system 100. When the hardware processor 140 determines that an ice formation condition is present at the indoor evaporator coil 120, the hardware processor 140 can trip the relay, disconnecting the air conditioning system 100 from the power source and turning the air conditioning system 100 off. The relay can be configured to have a first position and a second position, where the relay in the first position allows the air conditioning system 100 to receive power from the power source and the relay in the second position prevents the air conditioning system 100 from receiving power from the power source. The relay can be biased to the first position.

In some embodiments, the relay can be reset from the second position to the first position by user input. For example, the thermostat 155 or the user interface device, as described above, can generate a notification when an ice formation condition is present at the indoor evaporator coil 120. The notification can prompt a user to reset the relay. The relay can be reset to allow the air conditioning system to receive power from the power source after receiving an input from a user.

Figure 5:
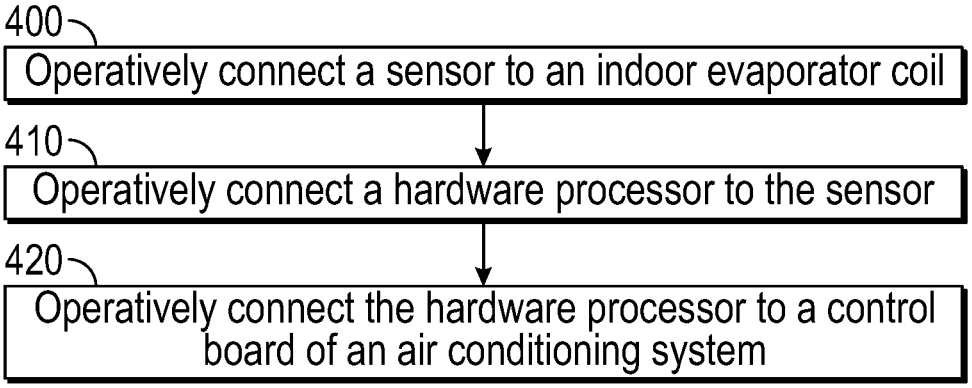
FIG. 5 is a flow chart showing an example process for installing an icing mitigation system in an air conditioner.

FIG. 5 is a flow chart showing an example process for installing an icing mitigation system in an air conditioner, such as the air conditioners disclosed with reference to FIG. 1, 2, or 3. While a particular order of steps is disclosed, the steps can be arranged in other orders unless otherwise indicated. Steps can be removed or added at any point in the process without deviating from the scope of this disclosure. The process can begin at step 400 at which the sensor 130 is operatively connected to the indoor evaporator coil 120. The process then proceeds to step 410 at which the hardware processor 140 is operatively connected to the sensor 130. The process then proceeds to step 420 at which the hardware processor 140 is operatively connected to the air conditioning system control board 150.

In some embodiments, the hardware processor 140 is installed separately from the air conditioning system control board 150. In other embodiments, the hardware processor 140 is installed as a part of the air conditioning system control board 150.

In some embodiments, the sensor 130 is a component of the hardware processor 140. For example, the sensor 130 is installed as a part of the hardware processor 140, and the hardware processor 140 is operatively connected to the indoor evaporator coil.

The various illustrative logical blocks, controllers, data structures, and processes described herein may be implemented as electronic hardware, computer software, or combinations of both. To clearly illustrate this interchangeability of hardware and software, various illustrative components, blocks, modules, and states have been described above generally in terms of their functionality. However, while the various modules are illustrated separately, they may share some or all of the same underlying logic or code. Certain of the logical blocks, controllers, and processes described herein may instead be implemented monolithically.

The various illustrative logical blocks, modules, data structures, and processes described herein may be implemented or performed by a machine, such as a computer, a processor, a digital signal processor (DSP), an application specific integrated circuit (ASIC), a filed programmable gate array (FPGA) or other programmable logic device, discrete gate or transistor logic, discrete hardware components, or any combination thereof designed to perform the functions described herein. A processor may be a microprocessor, a controller, a microcontroller, a state machine, combinations of the same, or the like.

Depending on the embodiment, certain acts, events, or functions of any of the processes or algorithms described herein can be performed in a different sequence, may be added, merged, or left out altogether. Thus, in certain embodiments, not all described acts or events are necessary for the practice of the processes. Moreover, in certain embodiments, acts or events may be performed concurrently, e.g., through multi-threaded processing, interrupt processing, or via multiple processors or processor cores, rather than sequentially.

It should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Moreover, any components, features, or steps illustrated and/or described in a particular embodiment herein can be applied to or used with any other embodiment(s). Thus, it is intended that the scope of the inventions herein disclosed should not be limited by the particular embodiments described above.

What is claimed is:

1. A system for preventing ice formation in an indoor evaporator unit of an open-environment system for cooling and/or dehumidifying an interior space by monitoring a temperature of an indoor evaporator coil disposed within the indoor evaporator unit, the system for preventing ice formation comprising:

a temperature sensor responsive to thermal energy of the indoor evaporator coil, the temperature sensor attached to the indoor evaporator coil of the indoor evaporator unit, the temperature sensor comprising a thermal contact in thermal communication with the indoor evaporator unit, the temperature sensor configured to generate a thermal data associated with the temperature of the indoor evaporator coil;

a hardware processor in electronic communication with the temperature sensor;

a memory device in electronic communication with the hardware processor, the memory device storing information comprising a threshold temperature value and machine readable instructions that, when executed, cause the hardware processor to:

receive the thermal data from the temperature sensor;

determine a temperature parameter of the indoor evaporator coil using the thermal data received from the temperature sensor;

compare the temperature parameter of the indoor evaporator coil to the threshold temperature value;

determine that ice formation conditions are present when the temperature parameter of the indoor evaporator coil is less than or equal to the threshold temperature value; and in response to determining that ice formation conditions are present, actuate a relay to stop operation of the open-environment system for cooling and/or dehumidifying an interior space and generate a notification signal indicating that ice formation conditions are present; and a user interface device comprising a display configured to display a maintenance notification in response to the hardware processor generating the notification signal, the maintenance notification prompting a user input, wherein the hardware processor prevents operation of the open-environmental system for cooling and/or dehumidifying the interior space prior to receipt of the user input; and wherein the hardware processor resets the relay and restores operation of the open-environmental system for cooling and/or dehumidifying the interior space upon receipt of the user input.

2. The system of claim 1, wherein the thermal data received from the temperature sensor comprises at least one of voltage, current, or resistance associated with the temperature of the indoor evaporator coil.

3. The system of claim 1, wherein the threshold temperature value is between 25 and 32 degrees Fahrenheit.

4. The system of claim 1, wherein the temperature sensor collects the thermal data continuously or intermittently.

5. The system of claim 1, wherein the user interface device is a mobile device.

6. The system of claim 1, wherein the user interface device is an electronic device located inside the system or a building.

7. The system of claim 1, wherein the maintenance notification is displayed on the user interface device until additional input is provided.

8. The system of claim 1, wherein the temperature sensor is attached at an inlet, an outlet, or a location between the inlet and the outlet of the indoor evaporator coil.

9. The system of claim 1, wherein the relay comprises a first position and a second position, the relay in the first position allowing operation of the open-environment system for cooling and/or dehumidifying the interior space, the relay in the second position stopping operation of the open-environment system for cooling and/or dehumidifying the interior space, wherein the relay is moved from the first position to the second position when the ice formation condition is present, and wherein the relay is moved from the second position to the first position when the user input is received.

10. An air conditioning system comprising:

the system of claim 1;

a compressor capable of generating refrigerant flow through the air conditioning system;

a blower capable of generating airflow across the indoor evaporator coil capable of transferring thermal energy from the airflow to the refrigerant flow;

an expansion valve capable of reducing refrigerant pressure; and a filter capable of filtering the airflow.

11. The system of claim 1, wherein the maintenance notification is generated after a delay period elapses after a determination that ice formation conditions are present.

12. A method of preventing ice formation in an indoor evaporator unit of an open-environment system for cooling and/or dehumidifying an interior space, the method comprising:

receiving, by a hardware processor of an icing prevention system, thermal data from a sensor in thermal communication with the indoor evaporator unit of the open-environment system, the sensor responsive to thermal energy of the indoor evaporator unit;

comparing, by the hardware processor, the thermal data of the indoor evaporator coil to a threshold value;

determining, by the hardware processor, that an ice formation condition is present based on the comparison between the thermal data of the indoor evaporator coil to the threshold value;

in response to determining that an ice formation condition is present, actuating, by the hardware processor, a relay to stop operation of the open-environment system for cooling and/or dehumidifying the interior space;

generating, by the hardware processor, a notification signal indicating that an ice formation condition is present;

displaying, by the hardware processor, a maintenance notification in response to the hardware processor generating the notification signal, the maintenance notification prompting a user input;

maintaining, by the hardware processor, the stopped operation condition of the open-environment system for cooling and/or dehumidifying the interior space until the relay is reset, wherein the user input received via the maintenance notification resets the relay; and in response to reset of the relay, resuming, by the hardware processor, operation of the open-environment system for cooling and/or dehumidifying the interior space.

13. The method of claim 12, the thermal data from the sensor comprising at least one of voltage, current, or resistance associated with the temperature of the indoor evaporator coil.

14. The method of claim 12, wherein the threshold value is a threshold temperature value, a threshold voltage value, or a threshold current value.

15. The method of claim 12, wherein determining that the ice formation condition is present further comprises calculating a temperature parameter from the thermal data and comparing the temperature parameter to the threshold value.

16. The method of claim 12, wherein the notification signal is generated after a delay period after the determination that the ice formation condition is present.

17. A method for installing an icing prevention system to prevent ice formation in an indoor evaporator unit of an open-environment system for cooling and/or dehumidifying an interior space, the method comprising:

coupling a sensor to a first location of an indoor evaporator coil of the indoor evaporator unit, the sensor comprising a thermal contact in thermal communication with the indoor evaporator unit, the sensor configured to generate a thermal data associated with a temperature of the indoor evaporator coil;

establishing communication between a hardware processor of the icing prevention system and the sensor; and operatively connecting a relay of the icing prevention system to the hardware processor of the icing prevention system and to the open-environment system for cooling and/or dehumidifying an interior space, the relay comprising a first position and a second position, wherein the relay is configured to, when in the first position, allow operation of the open-environment system for cooling and/or dehumidifying an interior space, and wherein the relay is configured to, when in the second position, stop the operation of the open-environment system for cooling and/or dehumidifying an interior space, wherein:

the hardware processor comprises a memory device; and the memory device stores information comprising a threshold temperature value and machine readable instructions configured to, when executed, cause the hardware processor to:

receive a thermal data from the sensor;

determine a temperature parameter of the indoor evaporator coil using the thermal data received from the sensor;

determine that an ice formation condition is present when the temperature parameter of the indoor evaporator coil is less than or equal to the threshold temperature value;

actuate the relay from the first position to the second position;

generate and display a maintenance notification in response to the hardware processor determining that the ice formation condition is present, wherein the maintenance notification prompts a user input; and maintain the stopped operation condition of the open-environment system for cooling and/or dehumidifying the interior space until the user input is received, wherein the receipt of the user input resets the relay and restores operation of the open-environment system for cooling and/or dehumidifying the interior space.

18. The method of claim 17, wherein the thermal data generated by the sensor comprises at least one of voltage, current, or resistance associated with the temperature of the indoor evaporator coil.

19. The method of claim 17, wherein the threshold temperature value is between 25 and 32 degrees Fahrenheit.

20. The method of claim 17, wherein the maintenance notification is generated after a delay period after the determination that the ice formation condition is present.

21. A system for preventing ice formation in an indoor evaporator unit of an open-environment system for cooling and/or dehumidifying an interior space by monitoring a temperature of an indoor evaporator coil disposed within the indoor evaporator unit, the system for preventing ice formation comprising:

a sensor responsive to thermal energy of the indoor evaporator coil, the sensor comprising a thermal contact in thermal communication with the indoor evaporator unit, the sensor configured to monitor the temperature of the indoor evaporator coil of the indoor evaporator unit and generate thermal data associated with the temperature of the indoor evaporator coil;

a hardware processor in electronic communication with the sensor; and a memory device in electronic communication with the hardware processor, the memory device storing information comprising a threshold value and machine readable instructions configured to cause the hardware processor to:

receive the thermal data from the sensor;

compare the thermal data to the threshold value;

determine that ice formation conditions are present in the indoor air evaporator unit based on the comparison of the thermal data to the threshold value;

in response to a determination that ice formation conditions are present, actuate a relay to stop operation of the open-environment system for cooling and/or dehumidifying the interior space;

in response to the determination that ice formation conditions are present, generate and display a maintenance notification, wherein the maintenance notification prompts a user input; and maintain the stopped operation condition of the open-environment system for cooling and/or dehumidifying the interior space until the user input is received, wherein the receipt of the user input resets the relay and restores operation of the open-environment system for cooling and/or dehumidifying the interior space.

22. The system of claim 21, wherein the maintenance notification is generated after a delay period after the determination that ice formation conditions are present.

* * * * *